US009328439B2

(12) United States Patent
Lonati et al.

(10) Patent No.: US 9,328,439 B2
(45) Date of Patent: May 3, 2016

(54) ELECTROMAGNETIC ACTUATOR, PARTICULARLY FOR NEEDLE SELECTION DEVICES IN MACHINES FOR KNITTING, HOSIERY OR THE LIKE, WITH HIGH GAUGE

(71) Applicants: Andrea Lonati, Brescia (IT) SANTONI S.P.A., Brescia (IT)

(72) Inventors: Ettore Lonati, Botticino (IT); Fausto Lonati, Brescia (IT); Tiberio Lonati, Brescia (IT)

(73) Assignee: SANTONI S.P.A., Brescia (IT)

( * ) Notice: Subject to any disclaimer, the term of this patent is extended or adjusted under 35 U.S.C. 154(b) by 0 days.

(21) Appl. No.: 14/409,585

(22) PCT Filed: Jun. 12, 2013

(86) PCT No.: PCT/EP2013/062113
§ 371 (c)(1),
(2) Date: Dec. 19, 2014

(87) PCT Pub. No.: WO2013/189797
PCT Pub. Date: Dec. 27, 2013

(65) Prior Publication Data

US 2015/0197880 A1 Jul. 16, 2015

(30) Foreign Application Priority Data

Jun. 21, 2012 (IT) ..... MI2012A1091

(51) Int. Cl.
*D04B 15/78* (2006.01)

(52) U.S. Cl.
CPC ..... *D04B 15/78* (2013.01)

(58) Field of Classification Search
CPC ..... D04B 15/78; D04B 15/68
USPC ..... 66/218–221
See application file for complete search history.

(56) References Cited

U.S. PATENT DOCUMENTS 4,715,198 A * 12/1987 Ploppa ..... H01F 7/08 66/219
6,014,875 A 1/2000 Lonati et al.
(Continued)

FOREIGN PATENT DOCUMENTS

| | | | |
|---|---|---|---|
| EP | 0 874 077 | A2 | 10/1998 |
| EP | 1 739 218 | A1 | 1/2007 |
| EP | 2 100 991 | A1 | 9/2009 |
| IT | 0001357140 | | 3/2009 |

OTHER PUBLICATIONS

International Search Report and Written Opinion dated Nov. 27, 2013 issued in PCT/EP2013/062113.

*Primary Examiner* — Danny Worrell
(74) *Attorney, Agent, or Firm* — Scully, Scott, Murphy & Presser, P.C.

(57) ABSTRACT

An electromagnetic actuator, particularly for needle selection devices in machines for knitting, hosiery or the like, with high gauge. The electromagnetic actuator comprises a main magnet which has at least two polar regions which are side-by-side and separated by a gap and two selection electromagnets, each provided with at least one polar region which is aligned with the gap and spaced laterally from said gap. The at least one polar region of a selection electromagnet is arranged laterally on the side opposite to the at least one polar region of the other selection electromagnet with respect to the gap. The selection electromagnets can be activated individually to generate or cancel or reduce an attractive magnetic force at the corresponding polar region.

14 Claims, 9 Drawing Sheets

(56) References Cited

U.S. PATENT DOCUMENTS 6,584,810 B2 * 7/2003 Nakahata ..... D04B 15/78 66/219
6,651,464 B2 * 11/2003 Ueyama ..... D04B 15/78 66/219
6,962,065 B2 * 11/2005 Willmer ..... D04B 15/68 66/219
7,310,977 B2 * 12/2007 Ueyama ..... D04B 15/78 66/219
7,770,417 B2 * 8/2010 Lonati ..... D04B 15/78 66/219

* cited by examiner

ELECTROMAGNETIC ACTUATOR, PARTICULARLY FOR NEEDLE SELECTION DEVICES IN MACHINES FOR KNITTING, HOSIERY OR THE LIKE, WITH HIGH GAUGE

The present invention relates to an electromagnetic actuator, particularly for needle selection devices in machines for knitting, hosiery or the like, with high gauge.

Electromagnetic actuators for needle selection devices in machines for knitting, hosiery or the like are known.

These electromagnetic actuators are generally composed substantially of a main magnet, which has two side-by-side polar regions separated by a gap, and a selection electromagnet, which is provided with a ferromagnetic core that has at least one polar region arranged at the gap between the two polar regions of the main magnet. The selection electromagnet is provided with a coil that can be supplied with electric power in order to cancel or reduce substantially the attractive magnetic force of the polar region of the core of the selection electromagnet induced by the main magnet.

Needle selection devices that use these electromagnetic actuators generally comprise a plurality of selection elements that are made of a material that is susceptible of magnetic attraction, can move with respect to the electromagnetic actuator along an activation direction and, in their motion, face the polar regions of the main magnet and of the core of the selection electromagnet.

The electromagnetic actuator is arranged on the machine so that the polar regions are arranged sequentially along the direction of activation of the selection elements so that they, in their motion along the activation direction, face in succession with one of their sides first one of the polar regions of the main magnet, then the gap and the polar region of the core of the selection electromagnet and finally the other polar region of the main magnet.

Moreover, the selection elements can move from a first position, in which they are adjacent or even in contact with the above-cited polar regions, to a second position, in which they are spaced from the polar regions with respect to the first position. This mobility of the selection elements in the two positions corresponds to two different activations of the elements of the machine, generally needles, that must be selected by means of the selection device.

In practice, in many cases the movement of the selection elements from the second position to the first position is contrasted by an elastic element that tends to keep the corresponding selection element in the second position. Upstream of the electromagnetic actuator, an abutment, constituted generally by a cam, operates on the selection elements so that they all pass into the first position just before or at the first polar region of the main magnet that retains the selection elements in this position until the gap begins. At the gap, if the coil is supplied with electric power, the attractive force of the selection electromagnet core, produced by the main magnet, is canceled or substantially reduced to such an extent that it is insufficient to contrast the force of the elastic element that makes the selection element pass into the second position, in which it remains even during the passage at the second polar region of the main magnet, the attractive force of which is in itself insufficient to cause the passage of the selection element from the second position to the first position. Vice versa, if the coil of the selection electromagnet is not powered, the selection electromagnet core retains in the first position the selection element, which remains in this position and is retained in said first position also during the passage at the second polar region of the main magnet.

The selection element, depending on whether it is in the first position or in the second position, with consequent engagement or lack thereof with other elements of the machine, causes a different actuation of the element, generally a needle, of the machine that is correlated therewith, obtaining the desired selection.

In electromagnetic actuators of this kind, difficulties in sizing and supplying power to the selection electromagnet coil are observed, since in order to obtain a precise effect on the selection elements the intensity of the magnetic field induced by the electric power supply of the coil must be, at the gap, i.e. at the polar region of the selection electromagnetic coil, essentially equal and opposite to that of the magnetic field that is induced permanently in the selection electromagnet core by the main magnet. If the intensity of the magnetic field induced by the power supply of the coil were significantly lower or higher than that of the permanent magnetic field induced in the selection electromagnet core, the polar region of the selection electromagnet core would still produce an attraction of the selection element, achieving an effect that is the opposite to the desired one.

The sizing and power supply of the selection electromagnet coil in electromagnetic actuators of the known type are complicated, since the intensity of the magnetic field induced at the polar region of the selection electromagnet, and therefore the attraction force exerted by this polar region on the selection element, vary as a function of the number of selection elements that are in contact with or adjacent to the polar regions of the main magnet, since the selection elements produce, through their presence, a variation of the magnetic field of the main magnet, which in turn causes variations of the magnetic field induced in the selection electromagnet core that is arranged inside the main magnet, at the gap, between its polar regions.

In electromagnetic actuators of the known type, in order to avoid selection errors, it would be necessary to supply the selection electromagnet coil with a current the intensity of which is variable as a function of the various selection conditions, with considerable burdens as regards the management of the actuation of the electromagnetic actuators.

Italian patent no. 1,357,140 in the name of the same Applicant describes an electromagnetic actuator that solves the problems described above due to the fact that the selection electromagnet has at least one polar region that is aligned with the gap of the two polar regions of the main magnet and is spaced laterally from said gap.

Problems have been observed in the use of this type of electromagnetic actuator to actuate needle selection devices in circular hosiery or knitting machines with high gauge.

The dimension of the polar region of the selection electromagnet in alignment with the gap of the main magnet, along the direction of actuation of the selection elements with respect to the electromagnetic actuator, in fact must not be too wide; in particular, it must be smaller than or equal to the distance between two contiguous selection elements, because otherwise the selection electromagnet, by means of its polar region, would act simultaneously on two contiguous selection elements and therefore would be unable to actuate two contiguous selection elements differently.

This requirement clashes with the need for the same dimension of the polar region of the selection electromagnet to be wide enough to give time to the selection element on which it acts to move away enough to avoid being attracted again by the polar region of the main magnet that follows the polar region of the selection electromagnet when one wishes to actuate the selection element so that it passes from the first position to the second position.

In the case of machines with high gauges, i.e., with a very small distance between the selection elements along their actuation direction with respect to the electromagnetic actuator, and with high actuation speeds of the selection elements with respect to the selection electromagnet, even by utilizing all the space available, a dimension of the polar expansion of the selection electromagnet that is smaller than this distance is too small to be able to actuate correctly the selection elements.

The aim of the present invention is to solve the problem described above, providing an electromagnetic actuator for needle selection devices in machines for knitting, hosiery or the like that allows correct actuation of the selection elements even in case of high gauges and with high actuation speeds of the selection elements with respect to the electromagnetic actuator.

Within this aim, an object of the present invention is to provide an electromagnetic actuator that is highly reliable in operation.

Another object of the invention is to provide an electromagnetic actuator that has a limited space occupation.

A further object of the invention is to provide an electromagnetic actuator that retains the advantages of the electromagnetic actuator according to Italian patent no. 1,357,140 in terms of manufacturing and actuation simplicity.

This aim, as well as these and other objects that will become more apparent hereinafter, are achieved by an electromagnetic actuator, particularly for needle selection devices in machines for knitting, hosiery or the like, with high gauge, comprising a main magnet which has at least two polar regions which are side-by-side and separated by a gap, characterized in that it comprises two selection electromagnets, each one provided with at least one polar region which is aligned with said gap and spaced laterally from said gap, the at least one polar region of a selection electromagnet of said two selection electromagnets being arranged laterally on the side opposite to the at least one polar region of the other selection electromagnet of said two selection electromagnets with respect to said gap, said selection electromagnets being able to be activated individually to generate or cancel or reduce an attractive magnetic force at the corresponding polar region.

Further characteristics and advantages of the invention will become more apparent from the description of a preferred but not exclusive embodiment of the electromagnetic actuator according to the invention, illustrated by way of non-limiting example in the accompanying drawings, wherein.

Figure 1:
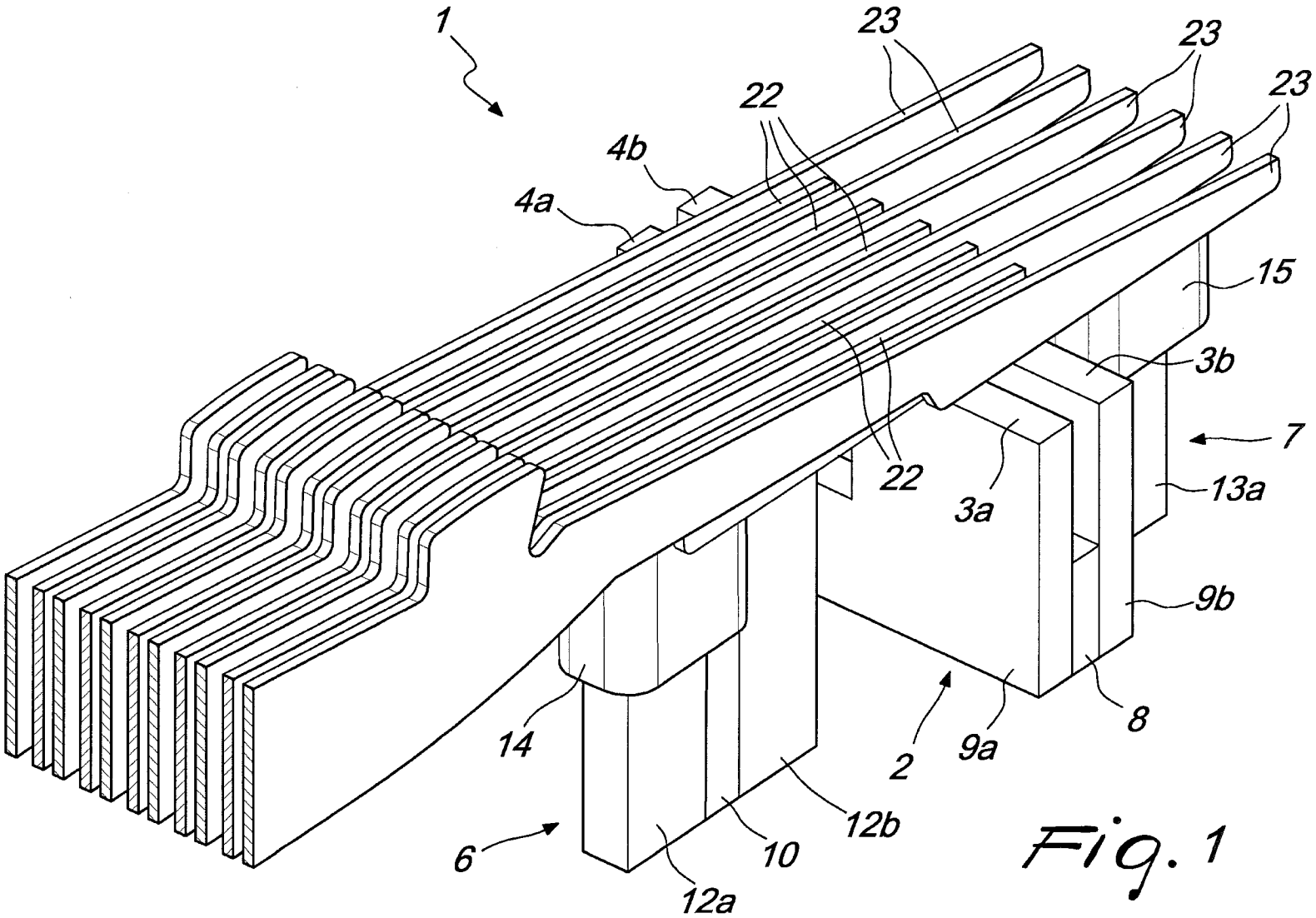
FIG. 1 is a perspective view of the actuator according to the invention which faces a plurality of selection elements of a needle selection device of a circular knitting machine, which are shown only partially for the sake of simplicity.

With reference to the cited figures, the electromagnetic actuator according to the invention, generally designated by the reference numeral 1, comprises a main magnet 2, which has at least two polar regions 3*a*, 4*a*, 3*b*, 4*b* that are arranged side by side and separated by a gap 5*a*, 5*b*.

According to the invention, the electromagnetic actuator also comprises two selection electromagnets 6, 7, each one provided with at least one polar region 6*a*, 6*b*, 7*a*, 7*b* that is aligned with the gap 5*a*, 5*b* of the main magnet 2 and is spaced laterally from said gap 5*a*, 5*b*. The at least one polar region 6*a*, 6*b* of the selection electromagnet 6 is arranged laterally on the side opposite to the at least one polar region 7*a*, 7*b* of the other selection electromagnet 7 with respect to the gap 5*a*, 5*b* of the main magnet 2. The selection electromagnets 6, 7 can be actuated individually in order to generate or cancel or reduce an attractive magnetic force at the corresponding polar region 6*a*, 6*b*, 7*a*, 7*b*, as will become more apparent hereinafter.

Conveniently, the selection electromagnets 6, 7 are spaced laterally from the main magnet 2 so that the gap 5*a*, 5*b* of the main magnet 2 is completely free from the polar regions of selection electromagnets.

More particularly, the main magnet 2, in the illustrated embodiment, comprises a permanent magnet 8, which is enclosed in a sandwich-like fashion between two yokes 9*a*, 9*b*, which form, with their ends, two pairs of polar regions, respectively a first pair of polar regions 3*a*, 3*b* and a second pair of polar regions 4*a*, 4*b*, in which the polar regions 3*a*, 4*a* are formed by the yoke 9*a* and the polar regions 3*b*, 4*b* are formed by the yoke 9*b*. The polar regions 3*a*, 4*a* of the yoke 9*a* are separated by a corresponding gap 5*a*, and likewise the polar regions 3*b*, 4*b* of the yoke 9*b* are separated by a corresponding gap 5*b*.

Each one of the two yokes 9*a*, 9*b* of the main magnet 2 is substantially U-shaped, with the corresponding gap 5*a*, 5*b* formed between the two free ends of the U-shape.

The permanent magnet 8 of the main magnet 2 is interposed between the two yokes 9*a*, 9*b* proximate to the region at which the two arms of each U-shape of the two yokes 9*a*, 9*b* join.

According to a constructive variation, which is not shown, the main magnet 2 can be provided with a single yoke and therefore with a single gap instead of two mutually aligned gaps as shown.

Each selection electromagnet 6, 7, in the illustrated embodiment, comprises a permanent magnet 10, 11, which is enclosed in a sandwich-like fashion between two mutually parallel bars 12*a*, 12*b*, 13*a*, 13*b*, which form, with one of their ends, two polar regions 6*a*, 6*b*, 7*a*, 7*b*, which are aligned with each other and with the gaps 5*a*, 5*b* of the main magnet 2. The two bars 12*a*, 12*b*, 13*a*, 13*b* are made of ferromagnetic material, so that by the effect of the permanent magnet 10, 11, an attractive force is generated, at the polar regions 6*a*, 6*b*, 7*a*, 7*b*, on a body made of ferromagnetic material that faces said polar regions 6*a*, 6*b*, 7*a*, 7*b*. Each selection electromagnet 6, 7 comprises an actuation coil 14, 15, which can be supplied with electric power for cancellation or reduction of the attractive magnetic force at the polar regions 6*a*, 6*b*, 7*a*, 7*b*.

The two polar regions 6*a*, 6*b*, 7*a*, 7*b* of each selection electromagnet 6, 7 are arranged side-by-side along a direction 16 that is substantially perpendicular to the direction of side-by-side arrangement 17 of the two polar regions 3*a*, 4*a* and 3*b*, 4*b* of the pairs of polar regions of the main magnet 2.

Conveniently, the polar regions 6*a*, 6*b*, 7*a*, 7*b* of the selection electromagnets 6, 7 are all mutually aligned along a direction 16 that is perpendicular to the direction of side-by-side arrangement 17 of the two polar regions 3*a*, 4*a* and 3*b*, 4*b* of the pairs of polar regions of the main magnet 2 between which the gaps 5*a*, 5*b*, also aligned along the direction 16, are formed.

Preferably, in each selection electromagnet 6, 7 the corresponding control coil 14, 15 is arranged around one of the two bars 12*a*, 12*b*, 13*a*, 13*b* that form the two polar regions 6*a*, 6*b*, 7*a*, 7*b* of the corresponding selection electromagnet 6, 7. In the illustrated embodiment, the control coil 14 of the selection electromagnet 6 is arranged around the bar 12*a*, while the control coil 15 of the selection electromagnet 7 is arranged around the bar 13*a*.

The electromagnetic actuator according to the invention is intended to be used preferably in needle selection devices for machines for knitting, hosiery or the like, with the two polar regions or the two pairs of polar regions 3*a*, 4*a*, 3*b*, 4*b* of the main magnet 2 arranged in sequence, in a substantially coplanar position, along an actuation direction, designated by the arrow 18, so that they face selection elements 22, 23 that are made of a material susceptible to magnetic attraction and can move along said actuation direction 18 with respect to the electromagnetic actuator 1.

In this manner, the selection elements 22, 23 face sequentially a first polar region or a first pair of polar regions 3*a*, 3*b* of the main magnet 2, then the gap 5*a*, 5*b* and the two polar regions 6*a*, 6*b* of a selection electromagnet 6 or the two polar regions 7*a*, 7*b* of the other selection electromagnet 7 and then a second polar region or a second pair of polar regions 4*a*, 4*b* of the main magnet 2.

The selection elements 22, 23 comprise first selection elements 22, which are adapted to interact with the polar regions 3*a*, 3*b*, 4*a*, 4*b* of the main magnet 2 and with the two polar regions 6*a*, 6*b* of the selection electromagnet 6, and second selection elements 23, which are adapted to interact with the polar regions 3*a*, 3*b*, 4*a*, 4*b* of the main magnet 2 and with the two polar regions 7*a*, 7*b* of the other selection electromagnet 7. Essentially, as is evident from the drawings, the first selection elements 22 are shorter than the second selection elements 23, which, thanks to their greater length, bypass the selection electromagnet 6 intended to interact with the first selection elements 22 and face the other selection electromagnet 7 intended to interact with them.

The selection elements 22, 23 are arranged so that in each instance, as a consequence of movement imparted to the selection elements 22, 23 with respect to the electromagnetic actuator 1 according to the invention, the gap 5*a*, 5*b* of the main magnet 2 faces a first selection element 22 and then a second selection element 23. In practice, the selection elements 22, 23 are arranged so that the first selection elements 22, which are shorter, are alternated with the second selection elements 23, which are longer.

The selection elements 22, 23 can move from a first position, in which they are kept adjacent to the polar regions 3*a*, 3*b*, 6*a*, 6*b*, 7*a*, 7*b*, 4*a*, 4*b* by the magnetic attraction exerted by said polar regions, to a second position, in which they are further spaced from the polar regions 3*a*, 3*b*, 6*a*, 6*b*, 7*a*, 7*b*, 4*a*, 4*b* than in the first position. Each selection element 22, 23, in order to pass from the first position to the second position and vice versa, can move on a plane that is perpendicular to the actuation direction 18 and the movement from the second position to the first position is contrasted by elastic means that can be constituted by a spring 24.

Without altering the fact that the electromagnetic actuator according to the invention can be used also with other types of needle selection devices, merely by way of example and only to further clarify its actuation, the operation of the electromagnetic actuator according to the invention is explained hereinafter with reference to a needle selection device 30 of the dial 31 of a circular knitting machine, similar to the one shown in Italian patent no. 1,293,789 in the name of the same Applicant, which uses, as selection elements 22, 23, levers which are pivoted, about a pivoting axis 32, to the end of the corresponding needle 30 that is opposite to the tip and can oscillate about said pivoting axis 32 in order to pass from the first position to the second position and vice versa. Specifically, the device shown in Italian patent no. 1,293,789 is provided with selection elements constituted by levers that have the same length, whereas the selection device shown in the accompanying drawings is provided with selection elements that are arranged so as to form alternately a first selection element 22, constituted by a short lever, and a second selection element 23, constituted by a long lever.

Figure 2:
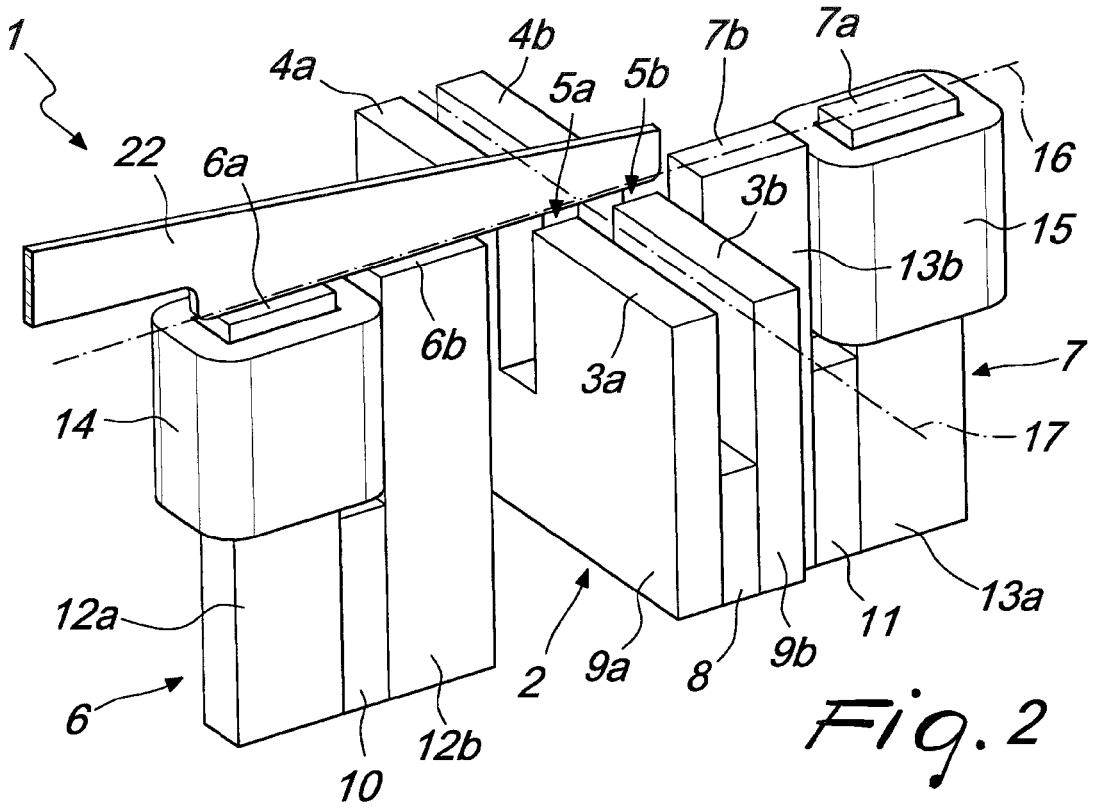
FIG. 2 is a view, similar to FIG. 1, of the actuator according to the invention, showing a selection element.
Figure 3:
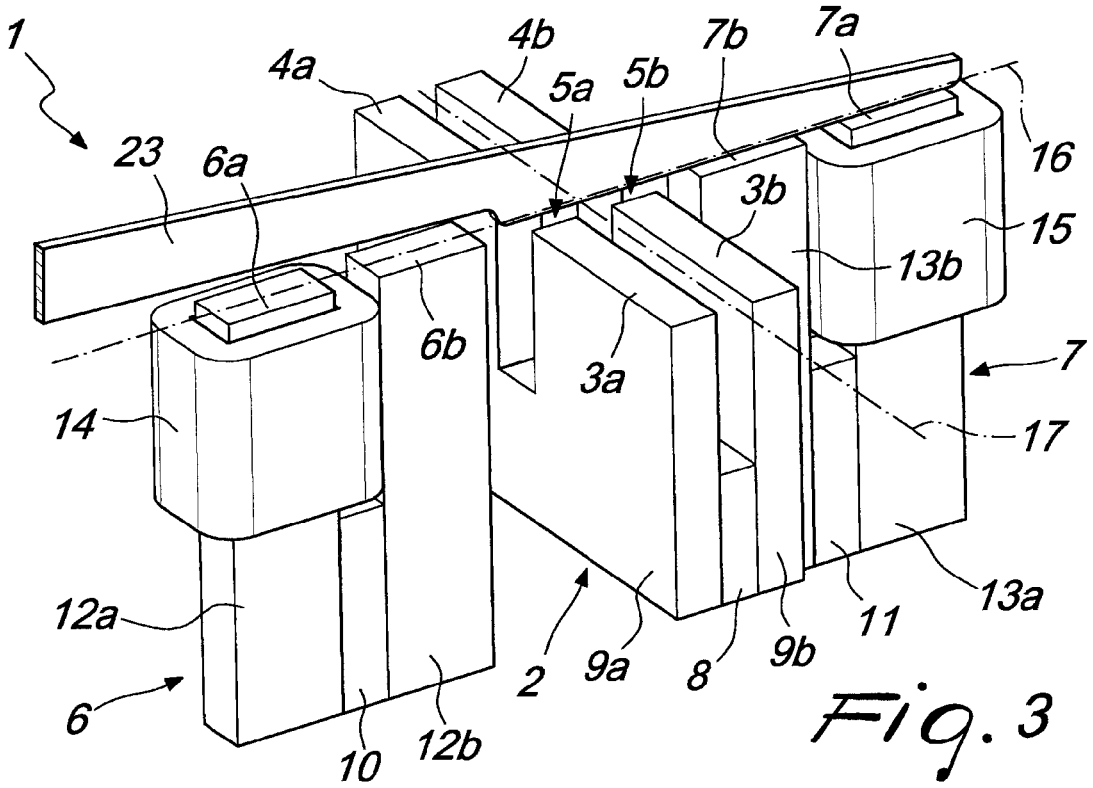
FIG. 3 is a view, similar to FIG. 1, of the actuator according to the invention, showing another selection element.
Figure 4:
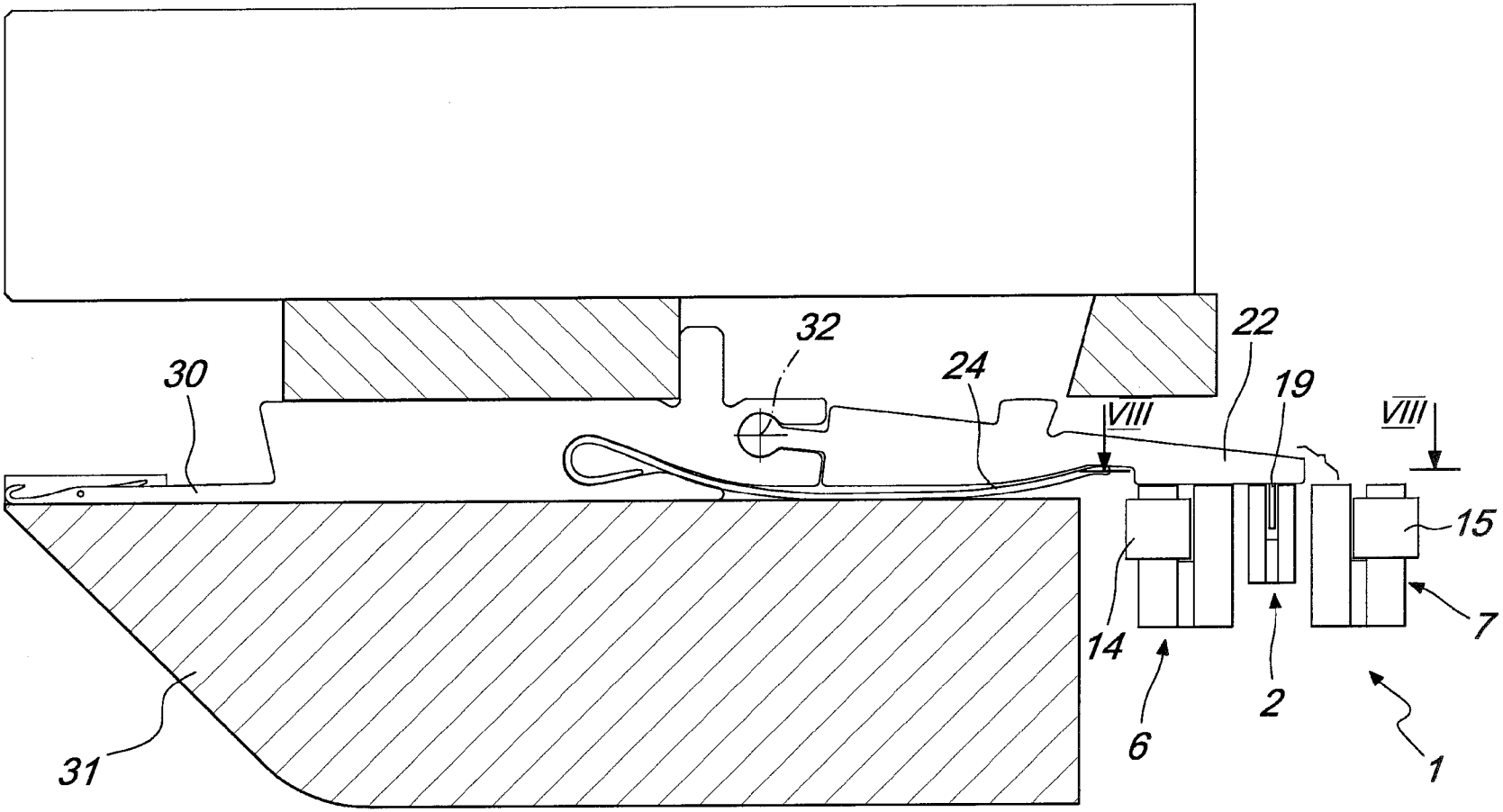
FIG. 4 is a lateral elevation view of the electromagnetic actuator according to the invention, applied to a needle selection device of the dial of a circular knitting machine, showing a selection element in a first position.
Figure 10:
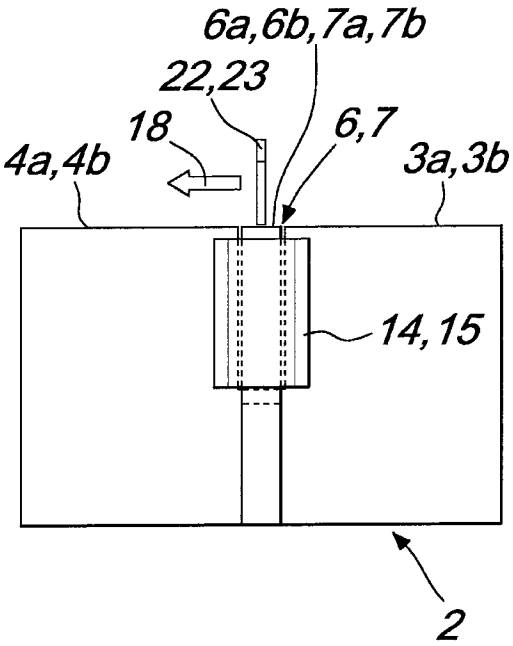
Figure 9:
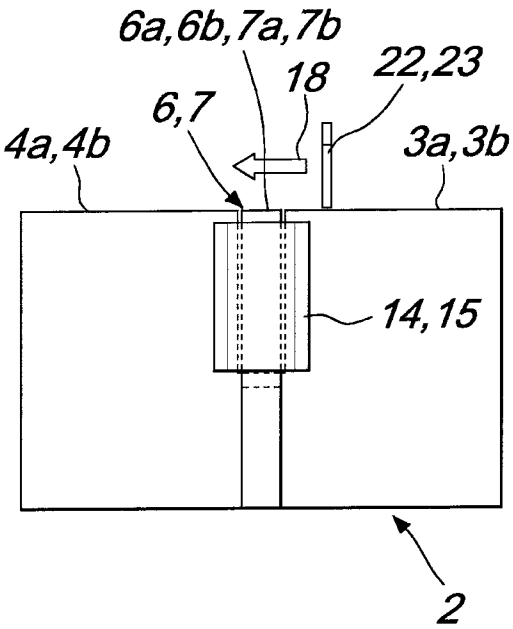

With an electromagnetic actuator according to the invention, each selection element 22, 23 is moved along the actuation direction 18 with respect to the electromagnetic actuator 1. Before the selection elements 22, 23 reach the first pair of polar regions 3*a*, 3*b* of the main magnet 2 or thereat, an abutment, constituted for example by a cam, acts on them, causing their passage from the second position to the first position, i.e., pushing them toward said polar regions 3*a*, 3*b*, which, as a consequence of their magnetic attraction, retain the selection elements 22, 23 in the first position, as shown in FIGS. 9 and 12. When one of the first selection elements 22 arrives at the gap 5*a*, 5*b* and thus faces with one of its portions the polar regions 6*a*, 6*b* of the selection electromagnet 6, if the actuation coil 14 is not supplied with power, the attractive action of these polar regions 6*a*, 6*b* produced by the permanent magnet 10 retains the first selection element 22 in the first position, as shown in FIGS. 2, 4, 10. Subsequently, said first selection element 22 faces the second pair of polar regions 4*a*, 4*b* of the main magnet 2 that retain said first selection element 22 in the first position, as shown in FIG. 11.

Figure 5:
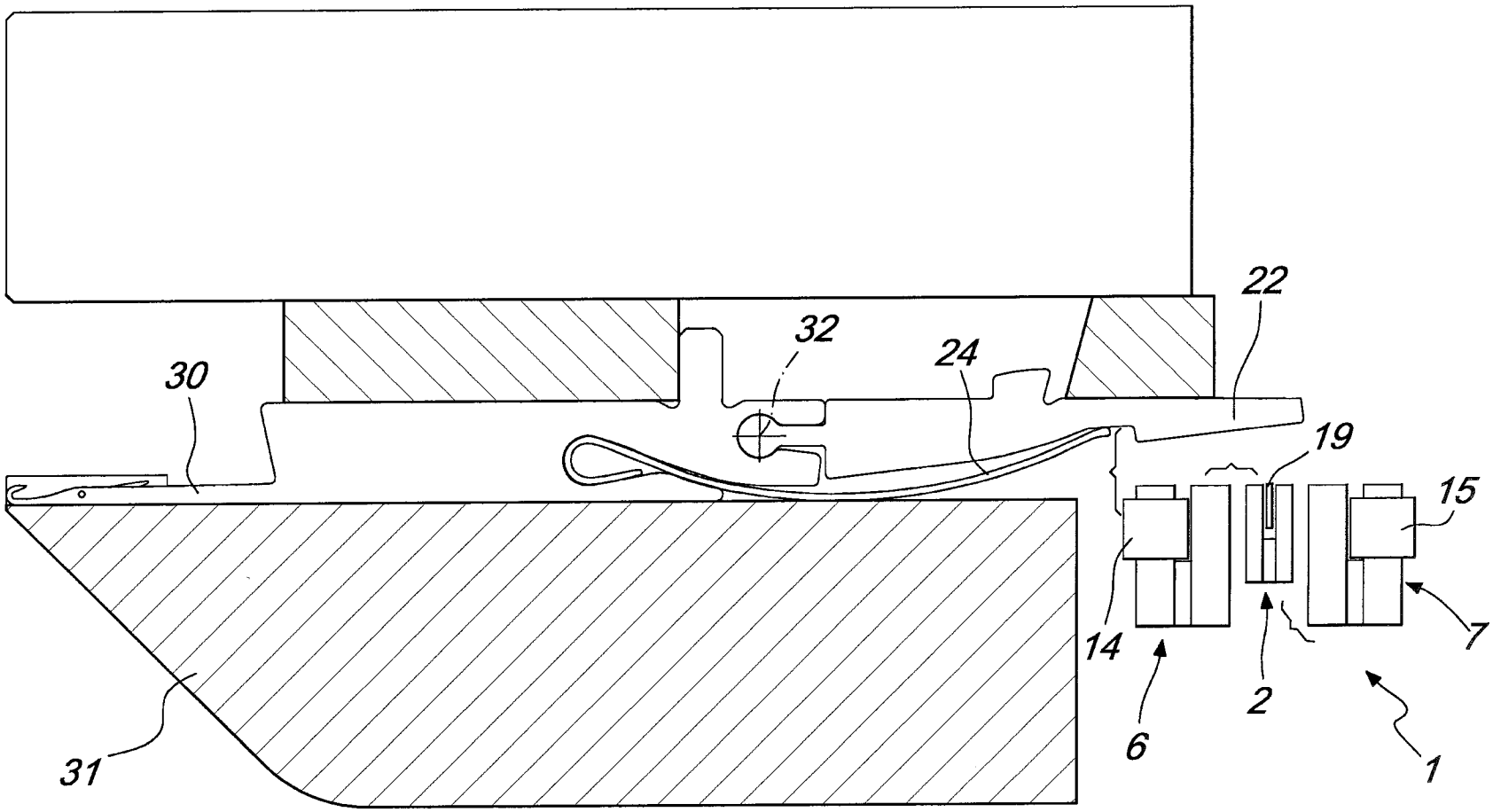
FIG. 5 is a lateral elevation view of the electromagnetic actuator according to the invention, applied to a needle selection device of the dial of a circular knitting machine, showing the selection element of FIG. 4 in a second position.
Figure 13:
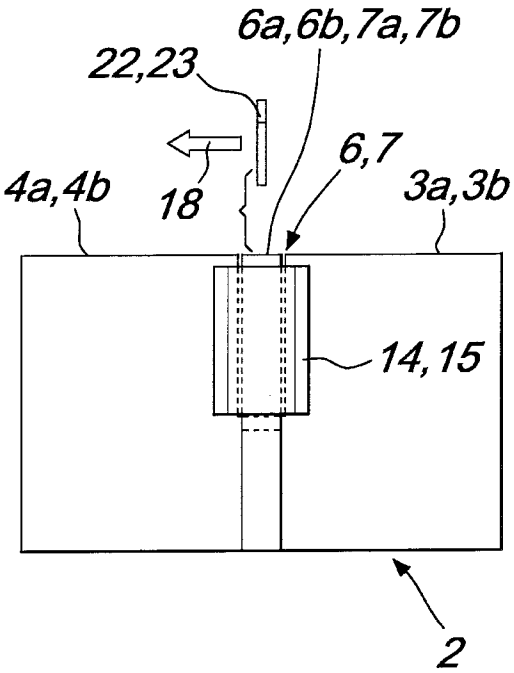

If vice versa the control coil 14 is supplied with power, the attractive force of the polar regions 6*a*, 6*b* of the selection electromagnet 6 is canceled or reduced and the first selection element 22 passes, through the action of the spring 24, to the second position, i.e., it moves away from the polar region, as shown in FIGS. 5 and 13. Then, during passage at the second pair of polar regions 4*a*, 4*b* of the main magnet 2, said first selection element 22 remains in the second position, as shown in FIG. 14.

Figure 6:
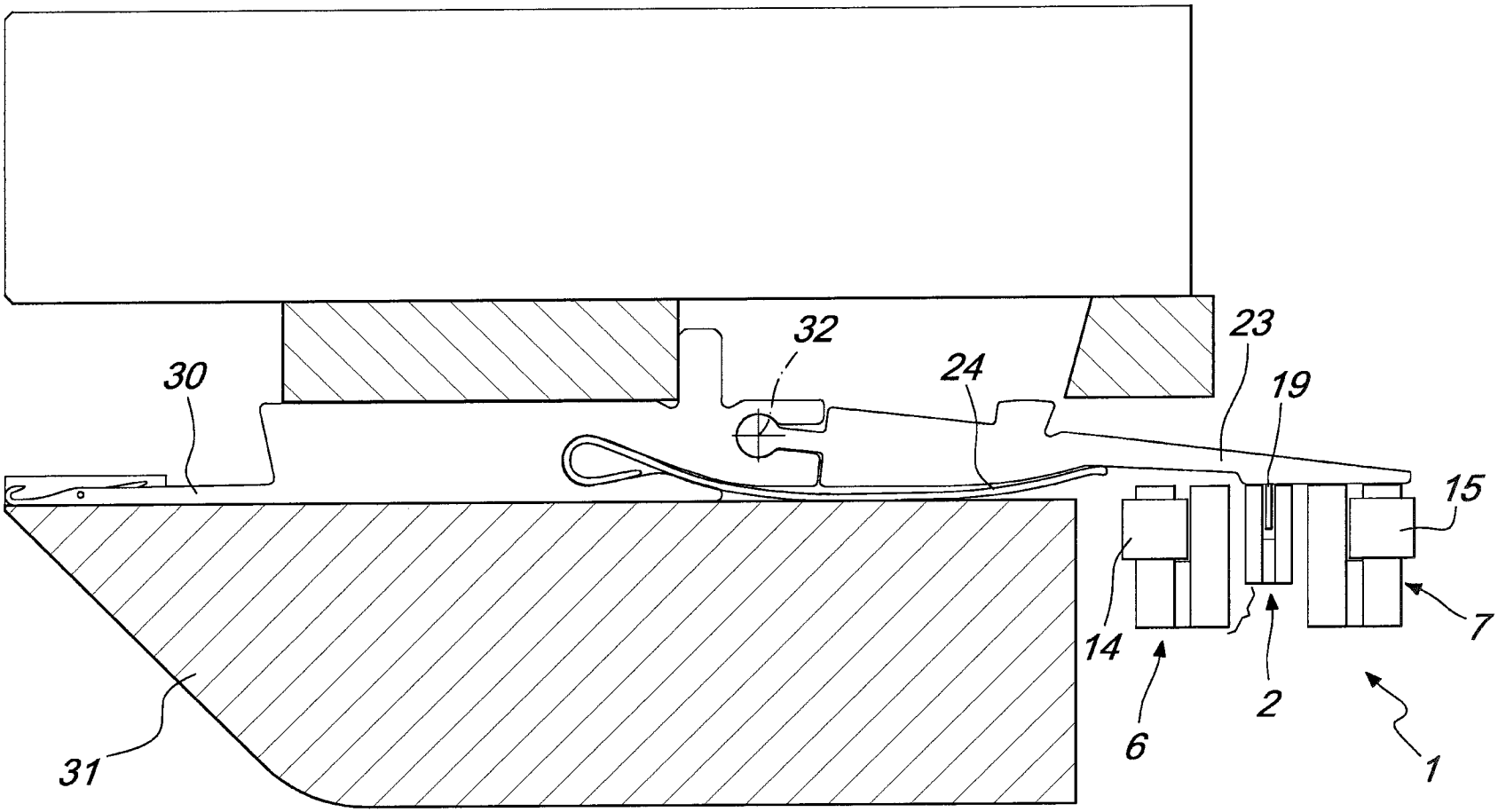
FIG. 6 is a lateral elevation view of the electromagnetic actuator according to the invention, applied to a needle selection device of the dial of a circular knitting machine, showing another selection element in a first position.
Figure 7:
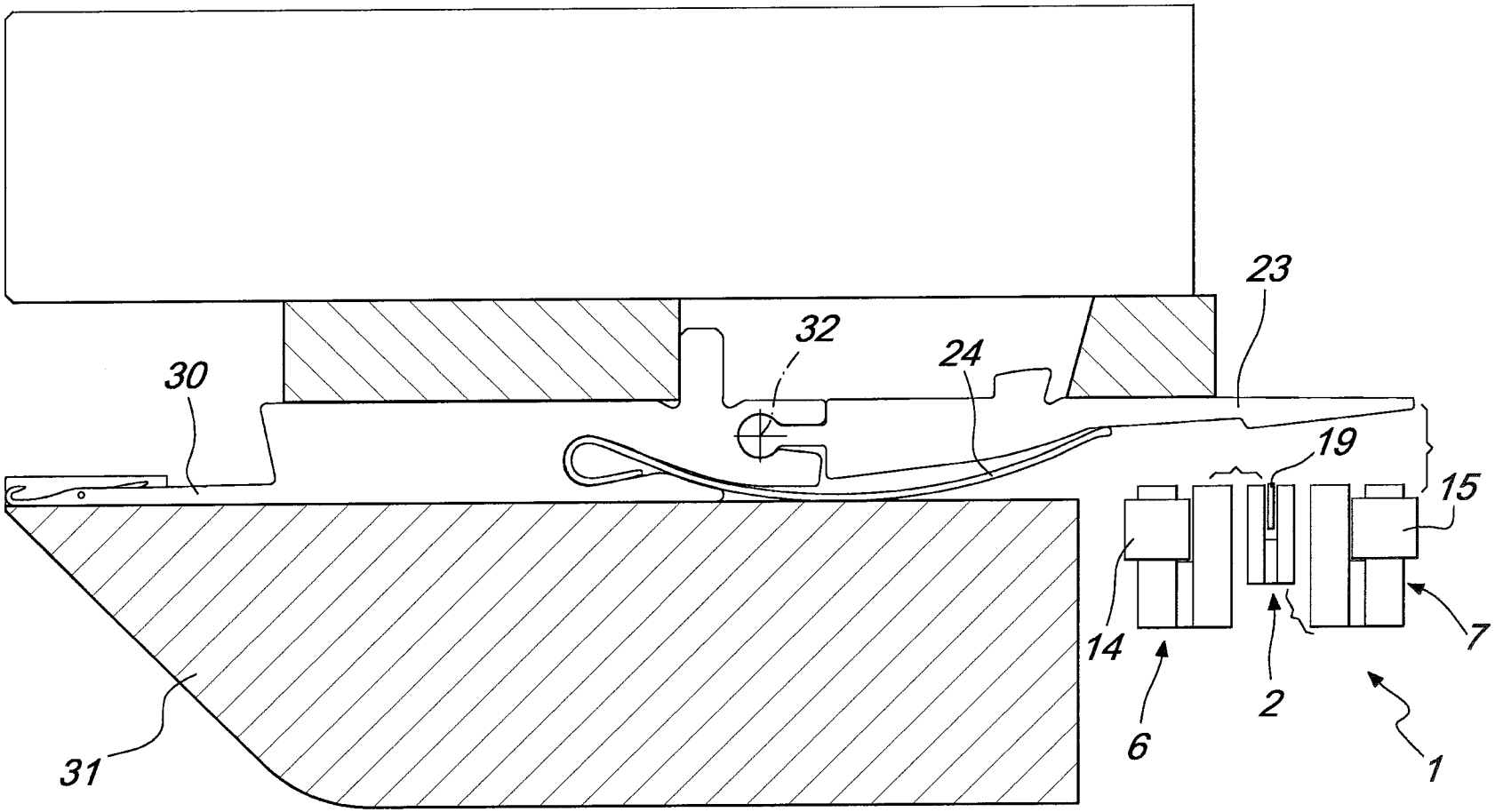
FIG. 7 is a lateral elevation view of the electromagnetic actuator according to the invention, applied to a needle selection device of the dial of a circular knitting machine, showing the selection element of FIG. 6 in a second position.
Figure 8:
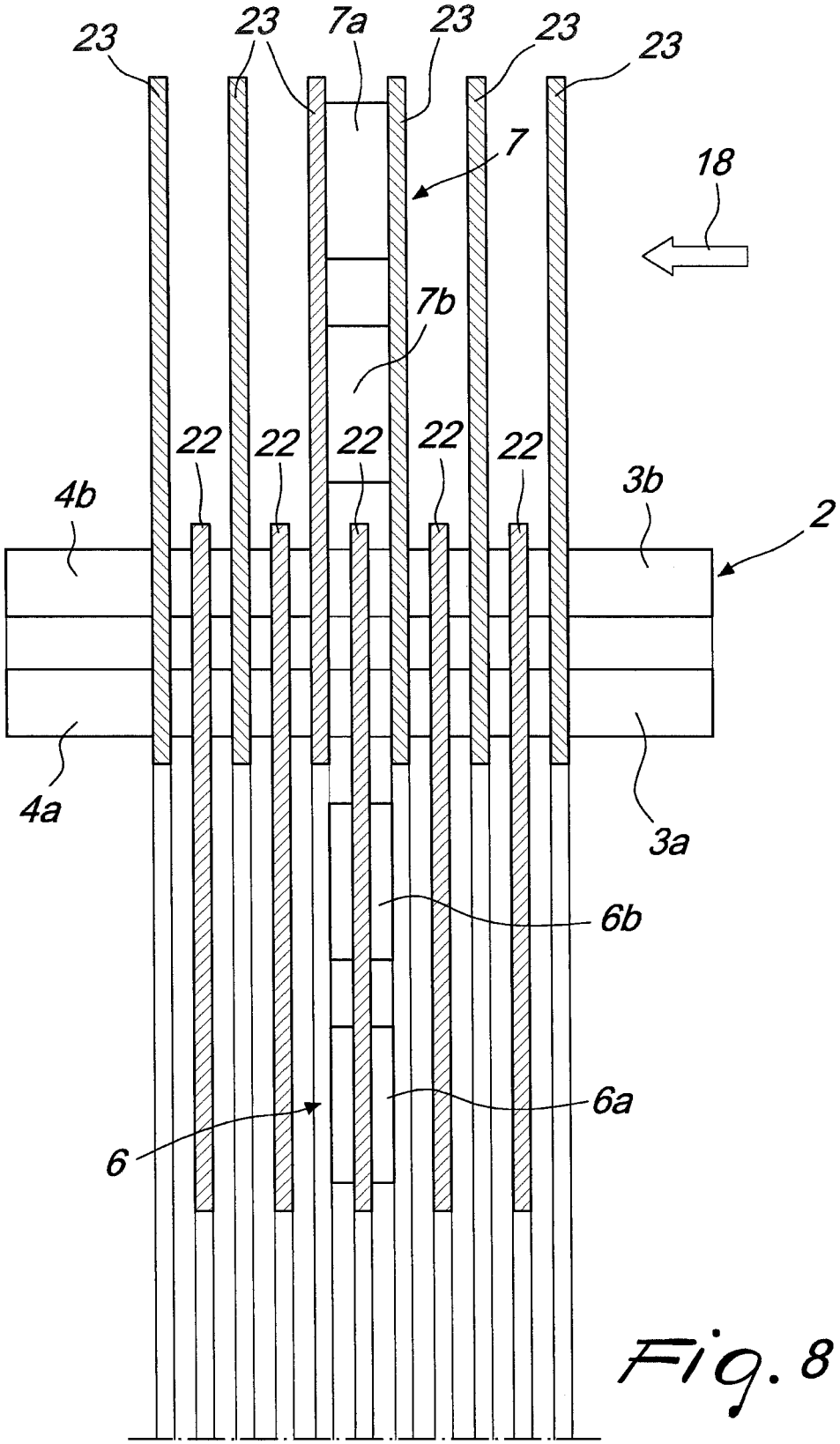
FIG. 8 is a schematic sectional view of FIG. 4 along the plane VIII-VIII, showing a plurality of selection elements.
Figure 11:
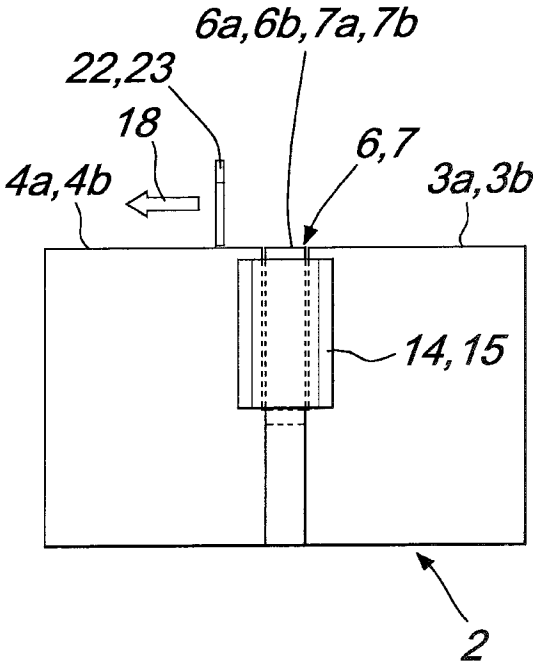
FIGS. 9 to 11 are schematic views of an actuation sequence of a selection element with the electromagnetic actuator according to the invention shown in a front elevation view.
Figure 14:
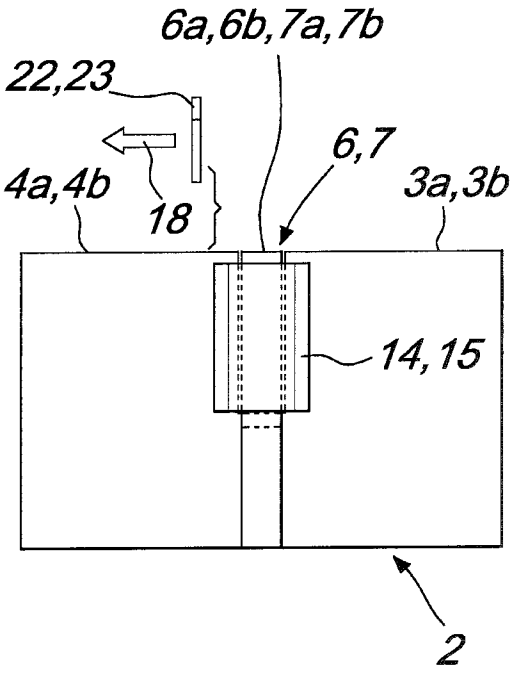
FIGS. 12 to 14 are schematic views of another actuation sequence of a selection element with the electromagnetic actuator according to the invention in a front elevation view.
Figure 12:
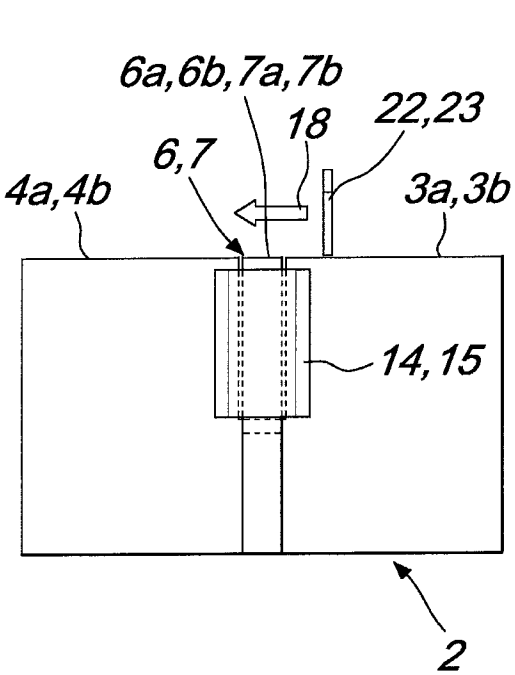

Likewise, when one of the second selection elements 23 arrives at the gap 5*a*, 5*b* of the main magnet 2, by not powering or powering the control coil 15 of the selection electromagnet 7 said second selection element 23 is kept in the first position, as shown in FIG. 6, so that subsequently, by facing the second pair of polar regions 4*a*, 4*b* of the main magnet 2, said second selection element 23 remains in the first position, as shown in FIG. 11, or the transition of said second selection element 23 to the second position through the action of the spring 24 is produced, as shown in FIGS. 7 and 13, so that subsequently, by facing the second pair of polar regions 4*a*, 4*b* of the main magnet 2, said second selection element 23 remains in the second position, as shown in FIG. 14.

The different position assumed by the selection element 22, 23, after the passage at the gap 5*a*, 5*b* of the polar regions 3*a*, 3*b*, 4*a*, 4*b* and of the selection electromagnets 6, 7 is used for an engagement or disengagement of the selection element 22, 23 with actuation elements, for example cams, so as to cause a different actuation of the needle 30, to which the selection elements 22, 23 is connected and which is thus selected by means of the device.

The electromagnetic actuator according to the invention can also be provided in other embodiments that are within the protective scope of the present invention, for example by provision of the selection electromagnets 6, 7 with a simple core of ferromagnetic material instead of a permanent magnet. Regardless of the fact that the cores of the selection electromagnets 6, 7 may also have other shapes, the selection electromagnets may also be provided substantially as described and illustrated with reference to the accompanying drawings, simply by replacement of the permanent magnets 10, 11 described with reference to the above-cited drawings by ferromagnetic cores. Optionally, the cores of the selection electromagnets 6, 7 can be provided monolithically with the bars 12*a*, 12*b*, 13*a*, 13*b* of the corresponding selection electromagnet 6, 7.

In these further embodiments, in which the selection electromagnet does not have a permanent magnet, the operation of the electromagnetic actuator differs from the one described above in that when one wishes to keep a selection element 22, 23 in the first position at the gap 5*a*, 5*b* of the main magnet 2 the control coil 14, 15 of the selection electromagnet 6, 7 is supplied with power so that an attractive force is generated at the polar regions 6*a*, 6*b*, 7*a*, 7*b*, whereas when one wishes to induce the passage of the selection element 22, 23 from the first position to the second position the control coil 14, 15 of the selection electromagnet 6, 7 is not supplied with power.

Conveniently, the faces of the polar regions 3*a*, 3*b*, 6*a*, 6*b*, 7*a*, 7*b*, 4*a*, 4*b* of the main magnet 2 and of the selection electromagnets 6, 7 directed toward the selection elements 22, 23 are substantially co-planar.

Optionally, direct contact between the selection elements 22, 23 and the polar regions 3*a*, 3*b*, 6*a*, 6*b*, 7*a*, 7*b*, 4*a*, 4*b* can be avoided by the provision of adapted resting elements 19 for the selection elements 22, 23 for example proximate to the polar regions 3*a*, 3*b*, 4*a*, 4*b* of the main magnet 2.

It should be noted that in the electromagnetic actuator according to the invention, by means of the provision of two selection electromagnets 6, 7 arranged laterally on mutually opposite sides with respect to the gap 5*a*, 5*b* of the main magnet 2 and by the use of selection elements 22, 23 of different lengths which are mutually alternated and face respectively one and the other of the selection electromagnets 6, 7, in practice the space between the selection elements 22, 23 that is available to operate with one or the other of the selection electromagnets 6, 7 in practice is doubled. In this manner it is possible to have polar regions 6*a*, 6*b*, 7*a*, 7*b* of the selection electromagnets 6, 7 that are wide enough to have a precise and reliable actuation of the selection elements 22, 23 in high-gauge machines, i.e., having a reduced distance between two contiguous selection elements 22, 23, actuated at high speed, i.e., with a high movement speed of the selection elements 22, 23 along the actuation direction 18 with respect to the electromagnetic actuator 1.

In practice, by means of the electromagnetic actuator according to the invention it is possible to actuate in a different manner two contiguous selection elements 22, 23, i.e., keep one selection element 22 or 23 in the first position while the contiguous selection element 23 or 22 is moved to the second position or vice versa. This fact, in the use of the electromagnetic actuator according to the invention in a needle selection device of a hosiery or knitting machine or the like, means that it is possible to perform what is called needle-by-needle selection.

Furthermore, the solution of using a single main magnet 2 with two selection electromagnets 6, 7 has the advantage of a limited space occupation which simplifies the installation of the electromagnetic actuator on machines.

In practice it has been found that the electromagnetic actuator according to the invention achieves fully the intended aim and objects, since it allows correct actuation of the selection elements even in the case of high gauges and with high actuation speeds of the selection elements with respect to the electromagnetic actuator.

The electromagnetic actuator thus conceived is susceptible of numerous modifications and variations, all of which are within the scope of the appended claims; all the details may further be replaced with other technically equivalent elements.

In practice, the materials used, as long as they are compatible with the specific use, as well as the dimensions, may be any according to the requirements and the state of the art.

The disclosures in Italian Patent Application No. MI2012A001091 from which this application claims priority are incorporated herein by reference.

The invention claimed is:

1. A needle selection device for machines for knitting or hosiery, comprising:

an electromagnetic actuator comprising a main magnet which has at least two polar regions which are side-by-side and separated by a gap, two selection electromagnets, each one provided with at least one polar region which is aligned with said gap and spaced laterally from said gap, the at least one polar region of a selection electromagnet of said two selection electromagnets being arranged laterally on the side opposite to the at least one polar region of the other selection electromagnet of said two selection electromagnets with respect to said gap, said selection electromagnets configured for activation individually to generate, cancel or reduce an attractive magnetic force at a corresponding polar region of the other selection electromagnet, said at least two polar regions of the main magnet being arranged in sequence along an actuation direction; said needle selection device further comprising selection elements which can be attracted magnetically and can move along said actuation direction with respect to said electromagnetic actuator in order to face in sequence a first polar region of said polar regions of the main magnet, then said gap and said at least one polar region of a selection electromagnet or said at least one polar region of the other selection electromagnet and then a second polar region of said at least two polar regions of the main magnet; said selection elements comprising first selection elements which are adapted to interact with said polar regions of said main magnet and with said at least one polar region of a selection electromagnet, and second selection elements adapted to interact with said polar regions of said main magnet and with said at least one polar region of the other selection electromagnet; said selection elements being movable from a first position, in which they are kept adjacent to said polar regions of the main magnet y the magnetic attraction applied by said polar regions of the main magnet, to a second position, in which they are spaced further from said polar regions of said main magnet than in said first position; the control coil of each one of said selection electromagnets configured to receive electric power in order to keep the selection element interacting with the at least one polar region of the other selection electromagnet in said first position or to allow the passage of the selection element which interacts with the at least one polar region of the other selection electromagnet from said first position to said second position upon its passage at said gap and at said at least one polar region of the other selection electromagnet.

2. The device according to claim 1, wherein said first selection elements and said second selection elements are alternated along said actuation direction.

3. The device according to claim 1, wherein each one of said selection elements can move, in order to pass from said first position to said second position, on a plane which is substantially perpendicular to said actuation direction, through the action of elastic means.

4. The device according to claim 1, wherein faces of said polar regions of the main magnet and of the selection electromagnets directed toward said selection elements are substantially coplanar.

5. The device according to claim 1, wherein said selection electromagnets are spaced laterally, on mutually opposite sides, from said main magnet.

6. The device according to claim 1, wherein each one of said selection electromagnets comprises a core made of ferromagnetic material which defines, with one of the core's ends, the at least one polar region of the selection electromagnet and at least one control coil which can be supplied with electric power in order to generate, at said at least one polar region of the selection electromagnet, said attractive magnetic force.

7. The device according to claim 1, wherein each one of said selection electromagnets comprises a permanent magnet, which is connected magnetically to the corresponding at least one polar region of the selection electromagnet in order to generate, at said at least one polar region of the selection electromagnet, said attractive magnetic force, and at least one control coil configured to receive electric power so as to cancel or reduce said attractive magnetic force at said at least one polar region of the selection electromagnet.

8. The device according to claim 1, wherein said main magnet comprises a permanent magnet, which is enclosed between two yokes, which define, with ends thereof, two pairs of polar regions, which are separated by said gap.

9. The device according to claim 8, wherein each one of said two yokes of the main magnet is substantially U-shaped with said gap formed between two ends of the U-shape.

10. The device according to claim 9, wherein said permanent magnet of the main magnet is interposed between said two yokes proximate to a center region between the two arms of the U-shape of the two yokes.

11. The device according to claim 7, wherein said permanent magnet, or a core made of ferromagnetic material, of each selection electromagnet is enclosed between two bars, which define, with ends thereof, two polar regions in alignment with each other and with said gap.

12. The device according to claim 11, wherein said two polar regions of each selection electromagnet are aligned along a direction which is perpendicular to a direction of side-by-side arrangement of the at least two polar regions of said main magnet.

13. The device according to claim 12, wherein the polar regions of said selection electromagnets are mutually aligned along a direction which is perpendicular to said direction of side-by-side arrangement.

14. The device according to claim 11, wherein in each selection electromagnet a corresponding control coil is arranged around one of the two bars which define said two polar regions of the corresponding selection electromagnet.

* * * * *